US007596832B2

(12) United States Patent
Hsieh et al.

(10) Patent No.: US 7,596,832 B2
(45) Date of Patent: Oct. 6, 2009

(54) ROTATIONAL CASING ASSOCIATED WITH AN ELECTRONIC DEVICE

(75) Inventors: Ming-Ju Hsieh, Taipei Hsien (TW); Chi-Chun Chiang, Taipei Hsien (TW); Chin-Chia Chang, Taipei Hsien (TW)

(73) Assignee: Wistron Corp., Hsichi (TW)

( * ) Notice: Subject to any disclaimer, the term of this patent is extended or adjusted under 35 U.S.C. 154(b) by 477 days.

(21) Appl. No.: 11/448,104

(22) Filed: Jun. 7, 2006

(65) Prior Publication Data

US 2007/0101544 A1 May 10, 2007

(30) Foreign Application Priority Data

Nov. 9, 2005 (TW) ..... 94219399 U

(51) Int. Cl.
*E05C 17/64* (2006.01)

(52) U.S. Cl. ..... 16/342; 348/207.1; 348/373

(58) Field of Classification Search ..... 16/342, 16/374; 348/373, 207.1, 552, E5.025; 361/681, 361/683, 679.27; 396/429; 248/918
See application file for complete search history.

(56) References Cited

U.S. PATENT DOCUMENTS 6,141,052 A * 10/2000 Fukumitsu et al. ..... 348/373
6,930,725 B1 * 8/2005 Hayashi ..... 348/373
7,256,987 B2 * 8/2007 Weng ..... 361/683
7,412,163 B2 * 8/2008 Wu ..... 396/429
2006/0268157 A1 * 11/2006 Chang ..... 348/373
2008/0012944 A1 * 1/2008 Lu et al. ..... 348/207.1
2008/0266401 A1 * 10/2008 Fry et al. ..... 348/207.1

FOREIGN PATENT DOCUMENTS

CN 2658331 Y 10/2003
TW 556073 10/1992

* cited by examiner

*Primary Examiner*—William L. Miller

(57) ABSTRACT

An electronic device associated with a rotational casing includes a panel with a mount groove being joined to the rotational casing. The casing has a main body, which is composed of a first casing part and a second casing part, and a hinge. The main body has a projection part at a lateral side thereof and is received in the mount groove. The projection part extends outward a lateral side of the mount groove and is received in a locating groove of the panel corresponding to the projection part. The hinge is composed of a first hinge part and a second hinge part. The first hinge part is joined to another lateral side of the main body and an end of the second hinge part extends outward another lateral side of the mount groove and is joined to the panel. The present invention can hide the pivotal components and electrical wires to allow the rotational main body associated with the electronic device providing a sense of integral beauty.

13 Claims, 7 Drawing Sheets

ROTATIONAL CASING ASSOCIATED WITH AN ELECTRONIC DEVICE

BACKGROUND OF THE INVENTION

1. Field of the Invention

The present invention is related to a movable casing associated with an electronic device and particularly to a rotational casing, which is mounted in a mount groove of an electronic device.

2. Brief Description of Related Art

Taiwanese Patent No. 556073 discloses an information processing device with a display part and the display part includes a image picking device for picking up an image, a containing device for receiving the image picking device and a support device for supporting the containing device near the opposite end. The image picking device is guided to rotate outward about 180° at the vertical plane between a first position, which is the same direction of the first plane on the display part, and a second position, which is the same direction as the second plane on the display part.

U.S. Pat. No. 6,141,052 discloses a portable personal computer and electronic camera provides in which a liquid crystal display provides a mount groove and the mount groove has a semispherical elastic nest, which is movably joined to a rotational ball of a CCD video camera. The CCD video camera is capable of rotating freely in any directions once the CCD video camera is exerted a force by the user.

The image picking device of the preceding Taiwanese Patent is only possible to rotate outward about 180° at the vertical plane between a first position, which is the same direction of the first plane on the display part, and a second position, which is the same direction as the second plane on the display part. When the display part and the keyboard are arranged over 90°, the lens of the image picking device is incapable of positioning parallel to persons or the scene before the image picking device and the user is unable to turn the image picking device in order to turn the lens being parallel to the persons or the scene before the image picking device for taking better image.

The CCD video camera of the preceding U.S. patent exposes the ball shaped CCD video camera with the support members and the cable in the mount groove without a sense of beauty in spite of direction of the lens being adjustable.

SUMMARY OF THE INVENTION

The crux of the present invention is in that electronic device such as display of a portable computer associated with an electronic module is provided with a sense of beauty and offering a function of more conveniently being turned proper directions.

An object of the present invention is to provide a rotational casing associated with an electronic device with which the pivotally connecting parts and the electrical cables can be hide with integral beauty of the appearance thereof.

Another object of the present invention is to provide a rotational casing associated with an electronic device with which the pivotal connecting structure thereof is firmly arranged and the casing can be turned to an angular position desired by the user easily.

BRIEF DESCRIPTION OF THE DRAWINGS

The present invention can be more fully understood by reference to the following description and accompanying drawings, in which.

DETAILED DESCRIPTION OF THE INVENTION

Figure 1:
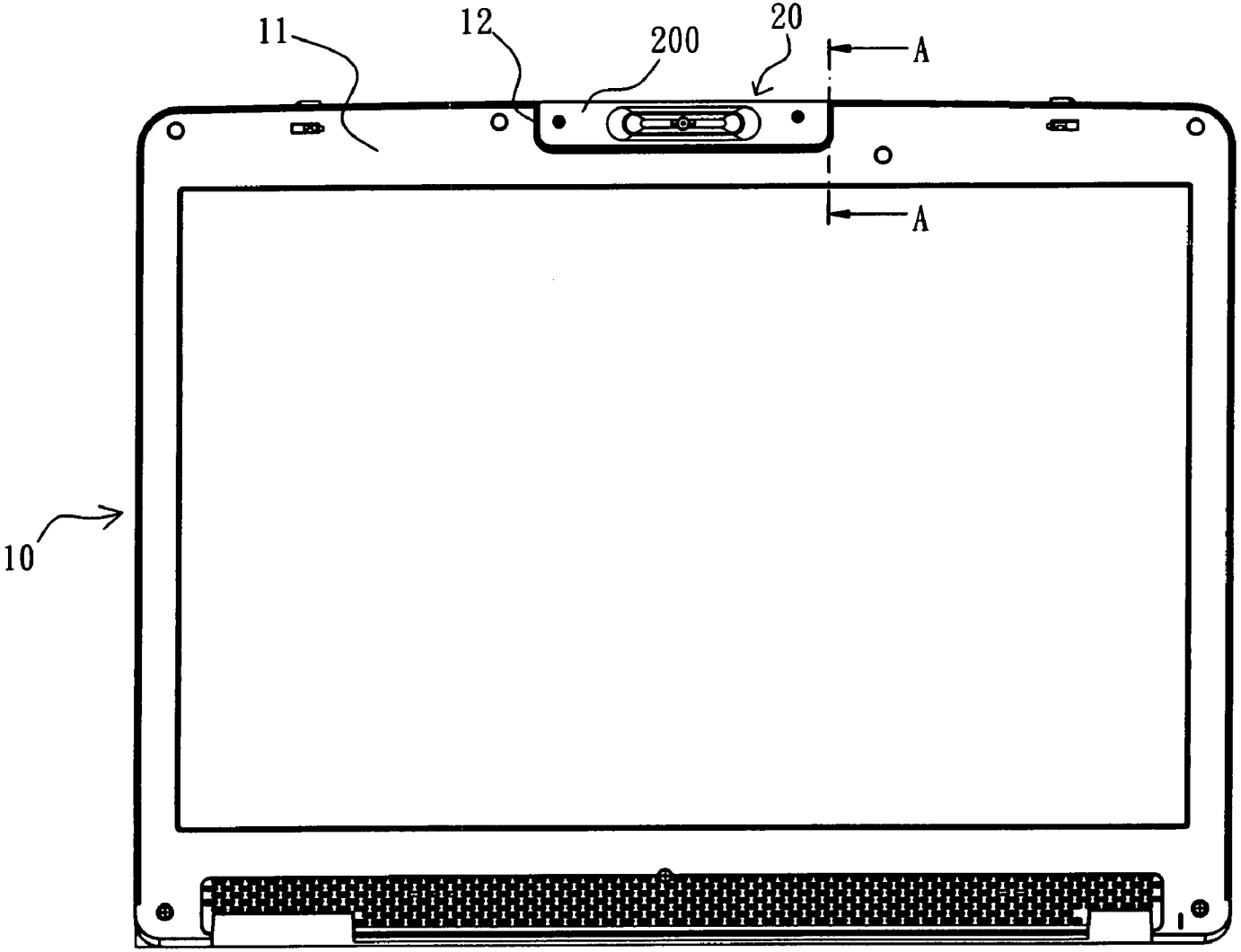
FIG. 1 is a top view of a rotational casing associated with an electronic device according to the present invention.
Figure 2:
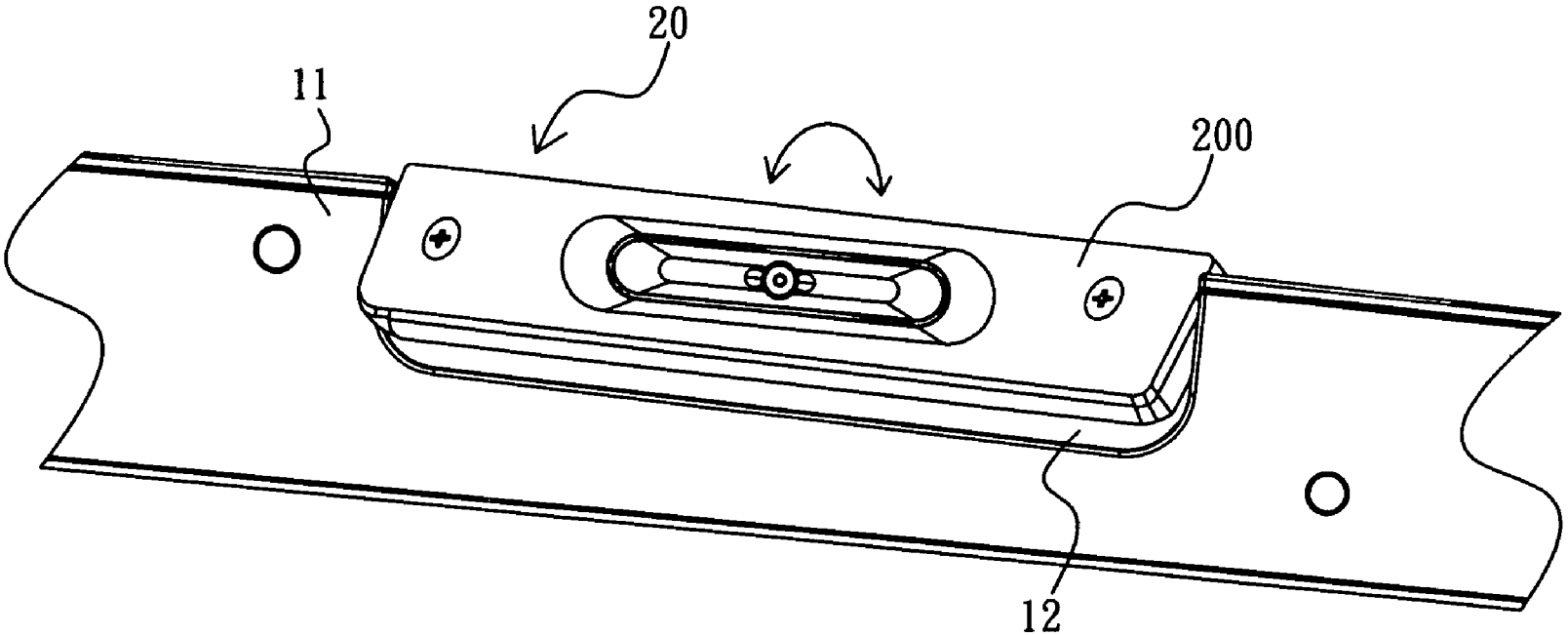
FIG. 2 is a fragmentary perspective view of a rotational casing associated with the electronic device according to the present invention.

Referring to FIGS. 1 and 2, a rotational casing associated with an electronic device includes an electronic device 10 and a rotational casing 20. The electronic device 10 has a mount groove 12 at the upper end of the panel 11 thereof. The panel 11 is joined to the casing 20 in a way of the main body 200 of the casing 20 being received in the mount groove 12. When the main body 200 is subjected to a foreign force, the casing 20 is able to rotate forward or rearward as shown in FIG. 2.

Figure 3:
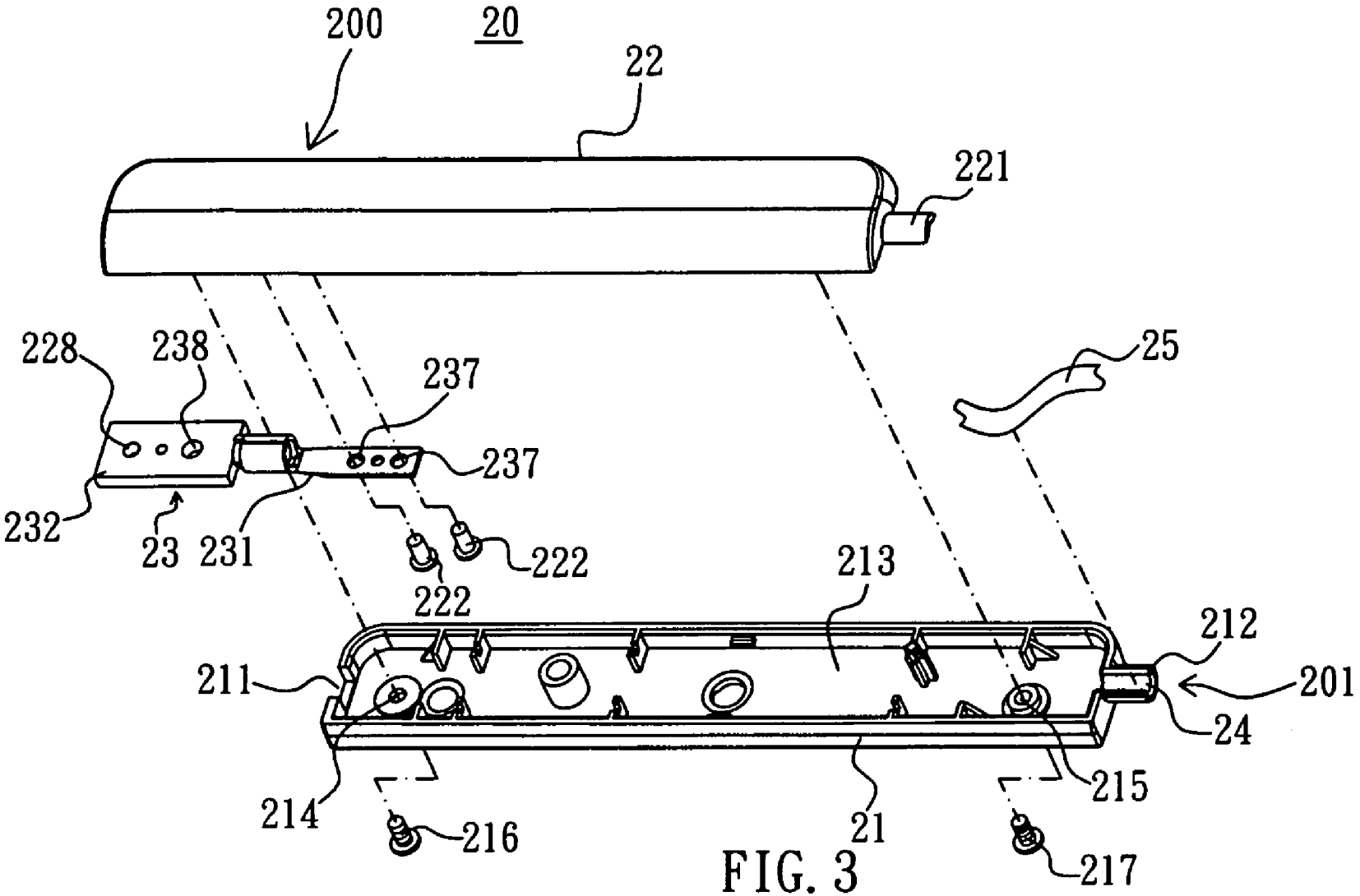
FIG. 3 is an exploded perspective view of a rotational casing according to the present invention.
Figure 4A:
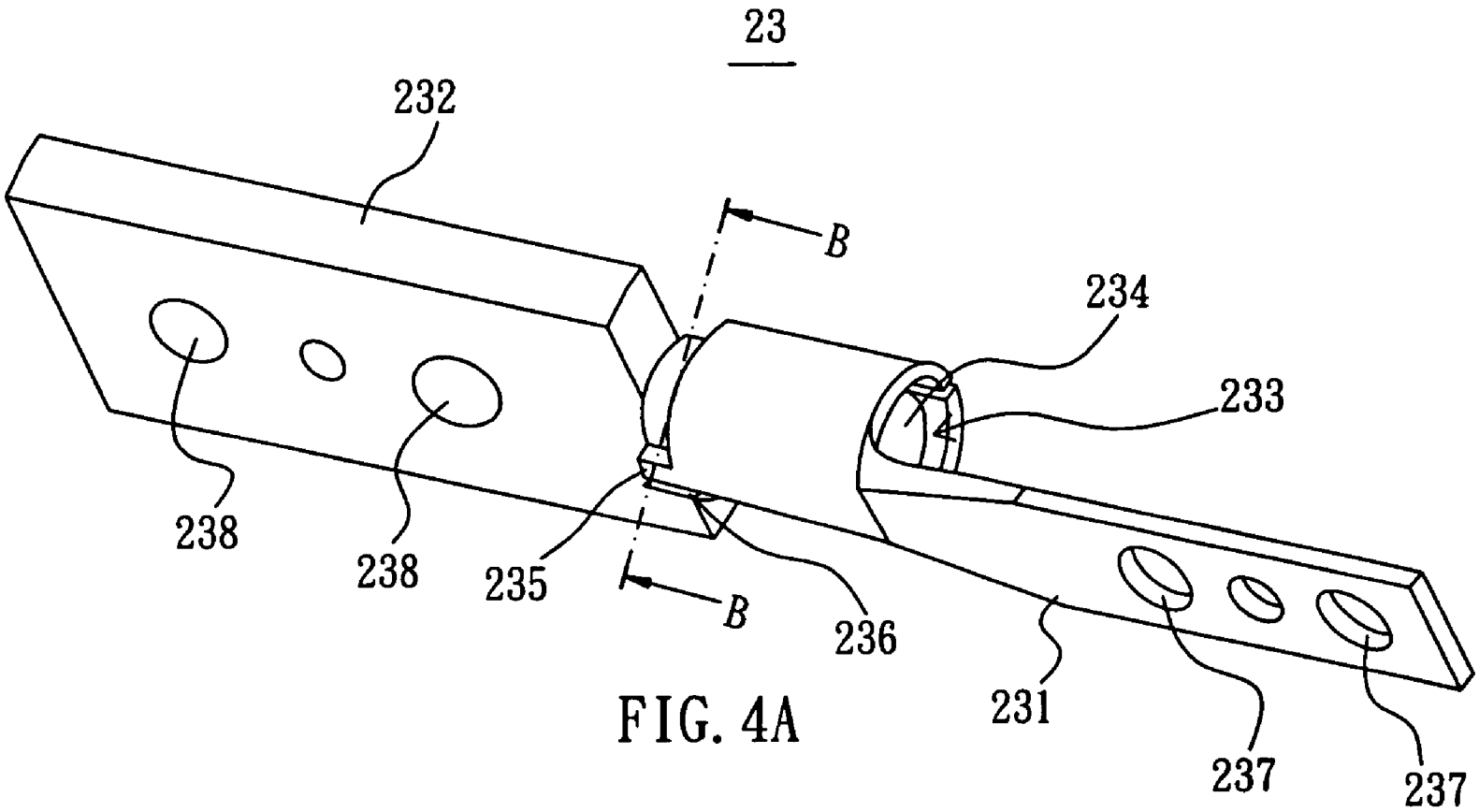
FIG. 4A is an exploded perspective view of a hinge arranged in the rotational casing of the present invention.
Figure 5:
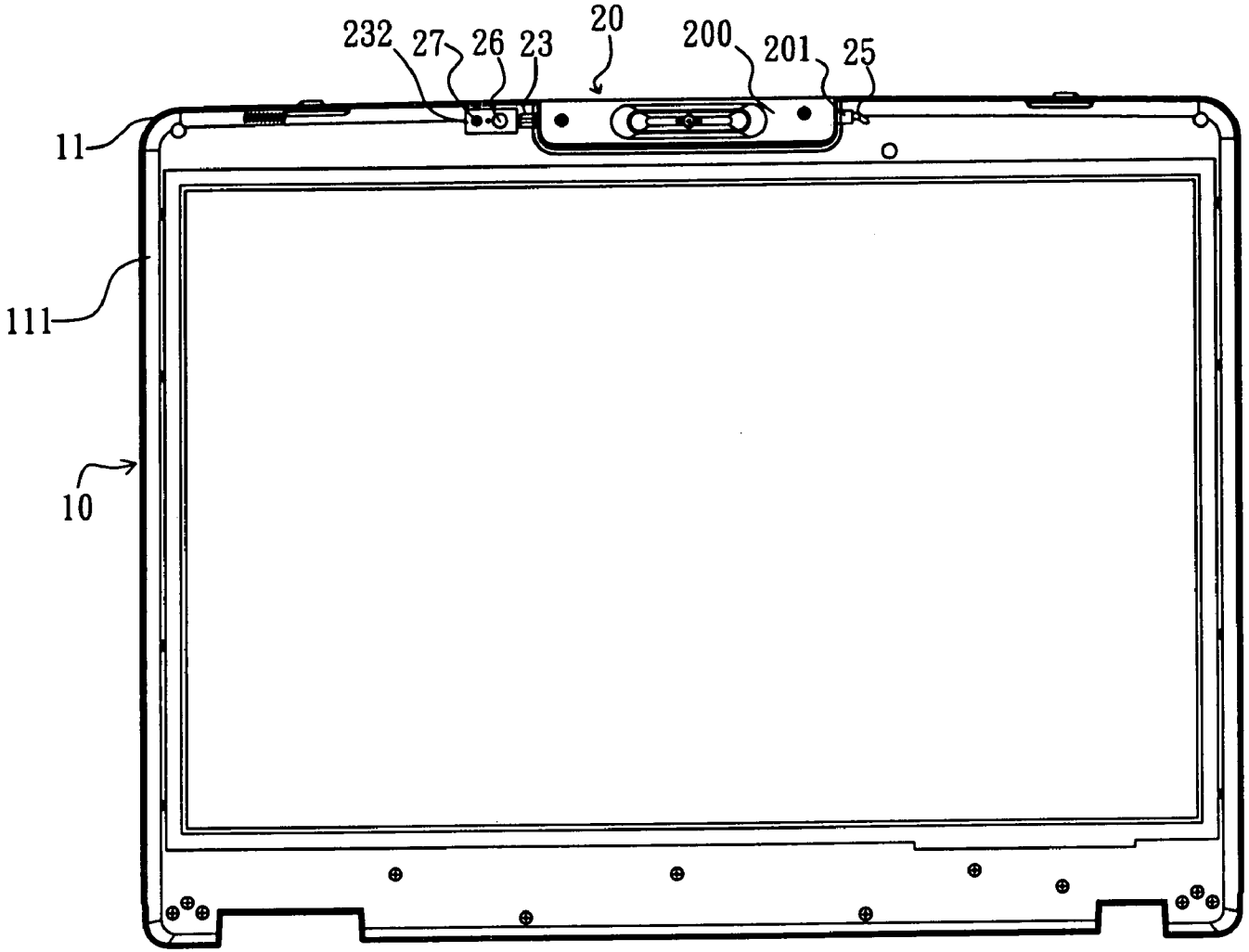
FIG. 5 is a top view of the case bottom of the electronic device with the rotational casing.

Referring to FIGS. 3, 4A and 5 companying with FIG. 1 again, a preferred embodiment of the casing 20 includes a main body 200 and a hinge 23. A lateral side of the main body 200 is attached to a first hinge part 231 of the hinge 23 and another lateral side of the main body 200 integrally attached to a projection part 201. The hinge 23 has a second hinge part 232 extends outward a lateral side of the mount groove 12 to join the panel 11. The projection part 201 extends outward another lateral side of the mount groove 12 to insert into the locating groove of the panel 11. The main body 200 is composed of a first casing part 21 and a second casing part 22. The first casing part 21 has a fitting hole 211 at an end thereof and has a first protrusion 212 at another end thereof. The first protrusion 212 provides a curved wall. The first casing part 21 has a flat wall 213 with a plurality of screw holes 214, 215. The second casing part 22 has a fitting hole (not shown) at an end thereof corresponding to the fitting hole 211. The second casing part 22 has a second protrusion 221 at another end thereof corresponding to the first protrusion 212 with a plurality of threaded holes inside (not shown) corresponding to the threaded holes 214, 215.

Figure 4B:
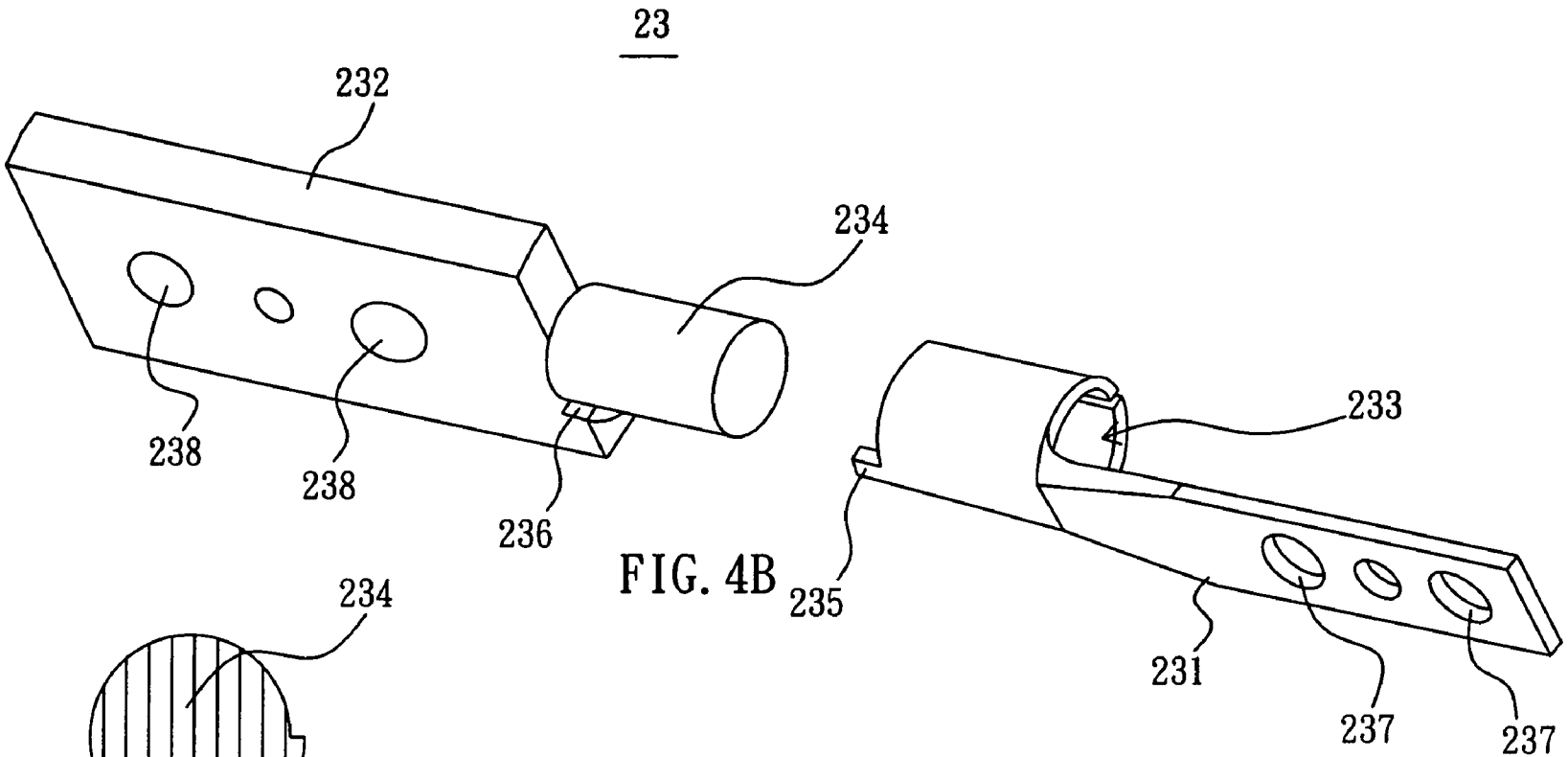
FIG. 4B is a perspective view of the hinge shown in FIG. 4A.
Figure 4C:
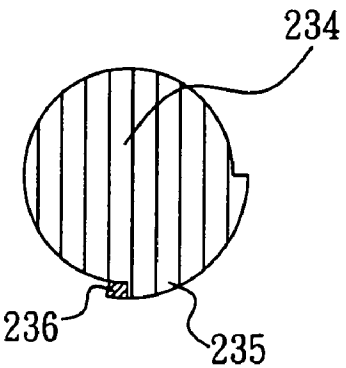
FIG. 4C is a sectional view along line B-B in FIG. 4A.

Referring to FIGS. 4B and 4C in company with FIGS. 3 and 4A, The hinge 23 shown in the figures is elongated with the first hinge part 231 connecting with the second hinge part 232. The first hinge part 231 provides a joining end with a pivotal hole 233 and the second hinge part 232 provides another joining end with a pivotal shaft 234. The pivotal hole 233 and the pivotal shaft correspond to each other. The pivotal hole 233 is inserted with the pivotal shaft 234 to form a pivotal connection such that the first hinge part 231 and the second hinge part 234 are capable of rotating relative to each other. A movable part 235 is provided at a portion of the first hinge part 231 contacting the pivotal shaft 234. The pivotal shaft 234 provides a limit unit 236 at two moving limit ends of the moving part 235 respectively such that the moving part 235 is capable of moving in a range between the two limit units 236 only for restricting relative rotation of the first hinge part 231 to the second hinge part 232 within 360 degrees. Another ends of the first and second hinge parts 231, 232, which are away the joint, are a flat shaped plate respectively and provides at least a through hole 237, 238. The pivotal hole 233, the pivotal shaft 234, the movable part 235 and the limit unit 236 can be arranged at either at the first hinge part 231 or the second hinge part 232 to perform the same effect as well.

Figure 6:
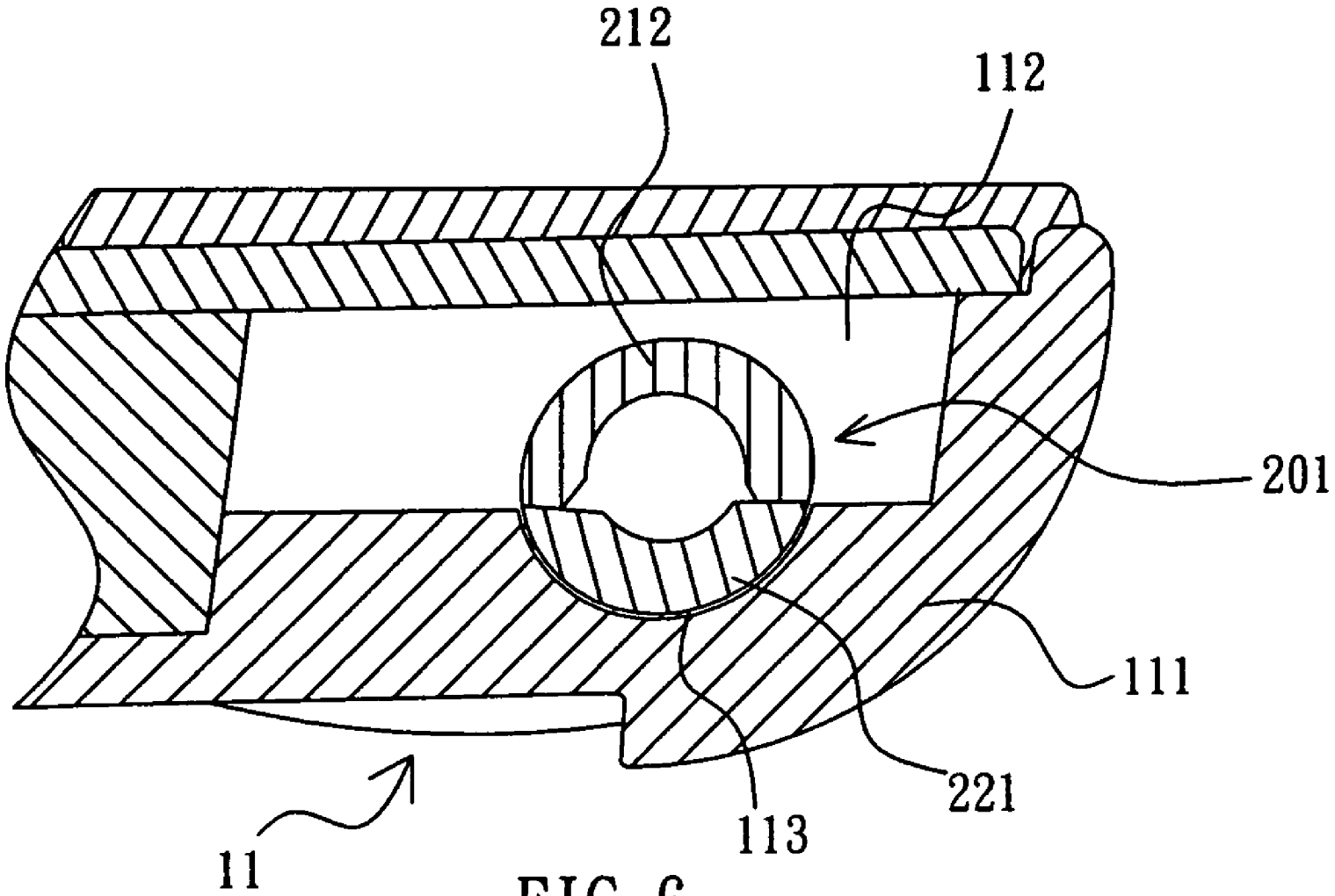
FIG. 6 is a sectional view along line A-A in FIG. 1 illustrating a locating groove of the display panel receiving a projection.

Referring to FIGS. 5 and 6 in company with FIGS. 3, 4A and 4B, in order to assemble the rotational casing to the electronic device, the second casing part 22 can be joined to the first hinge part 231 firmly with rivets 222 or screws passing through the through holes 237 of the first hinge part 231 and are fastened to rivet holes or threaded holes of the second casing part 22 corresponding to the through holes 237 of the first hinge part 231. The joint end between the first hinge part 231 and the second hinge part 232 is received in the fitting holes 211 of the first casing part 21 and the second casing part 22. The internal space confined by the assembled first casing part 21 and the second casing part 22 is available for placing an electronic module such as a video camera. The first protrusion 212 is joined to the second protrusion 221 as a projection part 201 with a central hole 24. The central hole 24 communicates the internal space and the external space of the main body 200 for accommodating electrical wire 25. The electrical wire 25 is used for electrically connecting the video camera inside the main body 200 to the external electronic device 10. A plurality of screws 216, 217 pass through the threaded holes 214, 215 of the first casing part 21 and are fastened to the corresponding threaded holes in the second casing part 21 such that the first casing part 21 can be joined to the second casing part 22 firmly. A plurality of screws 26, 27 or rivets pass through the through holes 238 of the second hinge part 232 and engage with corresponding threaded holes or rivet holes in a bottom plate 111 of the panel 11 such that the second hinge part 232 is capable of being joined to the bottom plate 111 firmly. The projection part 201 extends outward another lateral side of the mount groove 12 and received in corresponding a fitting hole 112 of the panel 11. The bottom plate 111 has a curved recess part 113 corresponding to the projection part 201. Normally, the projection part 201 does not contact the inner wall of the fitting hole 112 and the curved recess part 113. The main body 200 can rotate inward within an extent of about 90° at a vertical plane relative to the panel 11 or rotate outward within an extent of about 90° at a vertical plane relative to the panel 11.

The electronic device can be a mobile phone, a personal digital assistant or a portable computer. The digital video camera module can be provided in the main body. The appearance of the main body with the space in the mount groove allows the parts related to connection and electrical cables being hidden once the main body is movably joined to the electronic device so that the rotational main body associated with the electronic device reveals more elegant sense of integral beauty. Further, it is easy for the user to turn the main body to a proper angular position with a limit of rotational angle for avoiding the electrical wires being damaged caused by excessive rotation.

While the invention has been described with referencing to a preferred embodiment thereof, it is to be understood that modifications or variations may be easily made without departing from the spirit of this invention, which is defined by the appended claims.

What is claimed is:

1. A rotational casing, which is associated with an electronic device and capable of rotating with respect to the electronic device, comprising:

a main body, providing a projection part at a lateral side thereof, a hinge, being composed of a first hinge part and a second hinge part and the first hinge part being attached to another lateral side of the main body; wherein, the hinge parts have a connecting end respectively with one of the connecting ends being a pivotal hole and the other connecting end being a pivotal shaft corresponding to and inserting into the pivotal hole; one of the hinge parts has a movable part and the other hinge part has two limit units with the two limit units being disposed on the shaft corresponding to two limit ends of a moving range of the movable part for limiting the first hinge part and the second hinge part moving relative to each other within the moving range without excessive rotation, wherein the projection part of the main body has a central hole communicating with an internal space and an external space of the main body, wherein the main body is composed of a first casing part and a second casing part, wherein the first casing part has a first hole at an end thereof and a first protrusion with a curved wall at another end thereof, the second casing part has a second hole at an end thereof corresponding to the first hole and has a second protrusion at another end corresponding to the first protrusion and the projection part is formed with the first protrusion and the second protrusion.

2. The rotational casing as defined in claim 1, wherein the first casing part has first screw holes at a facial plate thereof and the second casing part has second screw holes at the inner side thereof corresponding to the first screw holes for the first casing part and the second casing part being joined together with screws.

3. The rotational casing as defined in claim 1, wherein the first hinge part and the second hinge part each has an elongated plate at another end the respectively with at least a through hole passing through the elongated plate and the second casing part has at least a hole corresponding to the through hole with at least a rivet inserting through the through hole and fastening to the hole of the second casing part for the second hinge part being joined to the second casing part.

4. The rotational casing as defined in claim 1, wherein pivotal ends of the first and second hinge parts are received in a corresponding fitting hole of the first casing part and the second casing part thereof respectively and the appearance of the main body complies with an inner space of a mount groove of the electronic device.

5. An electronic device associated with a rotational casing, comprising:

a panel, providing a mount groove and a locating groove; and the rotational casing; wherein the rotational casing further comprises;

a main body, providing a projection part at a lateral side thereof, being received in the mount groove, the projection part extending outward a lateral side of the mount groove and received in the locating groove;

a hinge, being composed of a first hinge part and a second hinge part with the first hinge part being attached to another lateral side of the main body and an end of the second hinge part extending outward another lateral side of the mount groove and being fixedly joined to the panel; wherein, the hinge parts have a connecting end respectively with one of the connecting ends being a pivotal hole and the other connecting end being a pivotal shaft corresponding to and inserting into the pivotal hole; one of the hinge parts has a movable part and the other hinge part has two limit units with the two limit units being disposed on the shaft corresponding to two limit ends of a moving range of the movable part for limiting the first hinge part and the second hinge part moving relative to each other within the moving range without excessive rotation, wherein the panel has a bottom plate with a curved part corresponding to the projection part of the main body.

6. The electronic device as defined in claim 5, wherein the projection part of the main body has a central hole communicating with an internal space and an external space of the main body.

7. The electronic device as defined in claim 5, wherein the main body is composed of a first casing part and a second casing part.

8. The electronic device as defined in claim 7, wherein the first casing part has a first hole at an end thereof and a first protrusion with a curved wall at another end thereof, the second casing part has a second hole at an end thereof corresponding to the first hole and has a second protrusion at another end corresponding to the first protrusion and the projection part is formed with the first protrusion and the second protrusion.

9. The electric device as defined in claim 8, wherein pivotal ends of the first and second hinge parts are received in a corresponding fitting hole of the first casing part and the second casing part thereof respectively and the appearance of the main body complies with the inner space of the mount groove.

10. The electronic device as defined in claim 7, wherein the first casing part has first screw holes at a facial plate thereof and the second casing part has second screw holes at the inner side thereof corresponding to the first screw holes for the first casing part and the second casing part being joined together with screw.

11. The electronic device as defined in claim 7, wherein the first hinge part and the second hinge part each has an elongated plate at another end thereof respectively with at least a through hole passing through the elongated plate and the second casing part has at least a hole corresponding to the through hole with at least a rivet inserting through the through hole and fastening to the hole of the second casing part for the second hinge part being joined to the second casing part.

12. The electronic device as defined in claim 11, wherein the panel has a bottom case plate with at east a threaded hole corresponding to the hole of the second hinge part and at least a screw passes through the hole of the second hinge part and engages with the threaded hole for the bottom case plate.

13. An electronic device associated with a rotational casing, comprising:

a panel, providing a mount groove and a locating groove; and the rotational casing; wherein the rotational casing further comprises;

a main body, providing a projection part at a lateral side thereof, being received in the mount groove, the projection part extending outward a lateral side of the mount groove and received in the locating groove;

a hinge, being composed of a first hinge part and a second hinge part with the first hinge part being attached to another lateral side of the main body and an end of the second hinge part extending outward another lateral side of the mount groove and being fixedly joined to the panel; wherein, the hinge parts have a connecting end respectively with one of the connecting ends being a pivotal hole and the other connecting end being a pivotal shaft corresponding to and inserting into the pivotal hole; one of the hinge parts has a movable part and the other hinge part has two limit units with the two limit units being disposed on the shaft corresponding to two limit ends of a moving range of the movable part for limiting the first hinge part and the second hinge part moving relative to each other within the moving range without excessive rotation, wherein the main body is composed of a first casing part and a second casing part, wherein the first casing part has a first hole at an end thereof and a first protrusion with a curved wall at another end thereof, the second casing part has a second hole at an end thereof corresponding to the first hole and has a second protrusion at another end corresponding to the first protrusion and the projection part is formed with the first protrusion and the second protrusion, wherein pivotal ends of the first and second hinge parts are received in a corresponding fitting hole of the first casing part and the second casing part thereof respectively and the appearance of the main body complies with the inner space of the mount groove.

* * * * *